US009297161B2

(12) United States Patent
Zimmerman et al.

(10) Patent No.: US 9,297,161 B2
(45) Date of Patent: Mar. 29, 2016

(54) ROOF MEMBER ANTI-TORSION BRACKET DEVICE AND METHOD OF USE

(75) Inventors: Steven Zimmerman, Linden, AL (US); Van T. Walworth, Lebanon, TN (US)

(73) Assignee: SR Systems LLC, Tuscaloosa, AL (US)

( * ) Notice: Subject to any disclaimer, the term of this patent is extended or adjusted under 35 U.S.C. 154(b) by 93 days.

(21) Appl. No.: 13/613,365

(22) Filed: Sep. 13, 2012

(65) Prior Publication Data

US 2013/0067851 A1 Mar. 21, 2013

Related U.S. Application Data

(60) Provisional application No. 61/685,794, filed on Mar. 26, 2012, provisional application No. 61/573,943, filed on Sep. 15, 2011.

(51) Int. Cl.
*E04B 1/24* (2006.01)
*E04B 7/04* (2006.01)
*E04B 1/26* (2006.01)

(52) U.S. Cl.
CPC . *E04B 7/045* (2013.01); *E04B 1/24* (2013.01); *E04B 1/2608* (2013.01); *E04B 1/2612* (2013.01)

(58) Field of Classification Search
CPC ..... E04B 1/00; E04B 1/38; E04B 1/2612; E04B 1/2608; E04B 2001/2415; E04B 7/045; E04B 1/24; E04B 1/08; E04B 2001/405
USPC ..... 52/92.1, 92.2, 93.2, 289, 702, 712, 643, 52/696, 690, 713, 715, 745.06; 248/300, 248/228.1; 403/232.1
See application file for complete search history.

(56) References Cited

U.S. PATENT DOCUMENTS 3,967,908 A * 7/1976 Snow et al. ..... 403/219
4,229,915 A * 10/1980 Snow et al. ..... 52/92.2
4,410,294 A * 10/1983 Gilb et al. ..... 403/27
4,669,235 A * 6/1987 Reinen ..... 52/98

(Continued)

FOREIGN PATENT DOCUMENTS

DE 2911427 A * 9/1980
FR 2730261 A1 * 8/1996

OTHER PUBLICATIONS

International Search Report for PCT/US2012/055805 mailed Feb. 1, 2013.

(Continued)

*Primary Examiner* — Adriana Figueroa
*Assistant Examiner* — Jessie Fonseca
(74) *Attorney, Agent, or Firm* — Harness, Dickey & Pierce, P.L.C.

(57) ABSTRACT

A roof member anti-torsion bracket device includes a base plate that is adapted to sit on a top plate of a wall construction and to receive a truss assembly. At least one transverse planar surface is oriented substantially transverse to the base plate. A locating tab extending longitudinally with respect to the base plate abuts an edge of the top plate, thereby locating the anti-torsion bracket device an offset distance from the edge of the wall construction top plate. The base plate further includes first and second fastening openings oppositely located with respect to the at least one transverse planar surface. The first and second fastening openings define first and second fastening positions in the base plate, thereby providing torsion resistance, compressive load support, and tension lifting resistance for the base plate.

22 Claims, 10 Drawing Sheets

(56) References Cited

U.S. PATENT DOCUMENTS

| | | | | |
|---|---|---|---|---|
| 4,932,173 | A * | 6/1990 | Commins | 52/92.2 |
| 5,111,632 | A * | 5/1992 | Turner | 52/702 |
| 5,335,469 | A * | 8/1994 | Stuart | 52/655.1 |
| 5,380,115 | A * | 1/1995 | Colonias | 403/170 |
| 5,481,844 | A * | 1/1996 | Kajita | 52/702 |
| 6,230,466 | B1 * | 5/2001 | Pryor | 52/702 |
| 6,311,449 | B1 * | 11/2001 | Morse et al. | 52/702 |
| 6,672,014 | B1 * | 1/2004 | Jones | 52/92.2 |
| 6,715,258 | B1 * | 4/2004 | Mueller | E04B 1/26 403/232.1 |
| 7,254,919 | B2 * | 8/2007 | Lutz et al. | 52/92.2 |
| 7,310,914 | B1 * | 12/2007 | Moore | 52/92.2 |
| 7,316,098 | B1 * | 1/2008 | Sackett | 52/92.2 |
| 7,398,620 | B1 * | 7/2008 | Jones | 52/92.2 |
| 7,690,167 | B2 | 4/2010 | Antonic | |
| 7,707,785 | B2 * | 5/2010 | Lin | 52/92.2 |
| 7,716,877 | B2 * | 5/2010 | Gilstrap et al. | 52/92.2 |
| 7,788,873 | B2 * | 9/2010 | Leek | 52/702 |
| 7,971,410 | B2 * | 7/2011 | Jerke | 52/702 |
| 7,987,636 | B2 * | 8/2011 | Hunt | 52/92.2 |
| 7,992,352 | B2 * | 8/2011 | Bonds et al. | 52/79.1 |
| 8,061,088 | B2 * | 11/2011 | Walker | 52/92.2 |
| 8,234,826 | B1 * | 8/2012 | Proffitt, Jr. | E02D 27/00 52/293.3 |
| 2003/0182875 | A1 | 10/2003 | Hill | |
| 2004/0079034 | A1 * | 4/2004 | Leek | 52/92.2 |
| 2005/0284057 | A1 * | 12/2005 | Commins | E04B 1/26 52/295 |
| 2008/0016791 | A1 * | 1/2008 | Walker | 52/92.2 |
| 2008/0244993 | A1 * | 10/2008 | Crumley | 52/92.2 |
| 2008/0282641 | A1 * | 11/2008 | Sackett | 52/715 |
| 2010/0162638 | A1 * | 7/2010 | Hunt | 52/92.2 |

OTHER PUBLICATIONS

Written Opinion of the International Searchilng Authority for PCT/US2012/055805 mailed Feb. 1, 2013.

* cited by examiner

ROOF MEMBER ANTI-TORSION BRACKET DEVICE AND METHOD OF USE

CROSS-REFERENCE TO RELATED APPLICATIONS

This application claims the benefit of U.S. Provisional Application No. 61/685,794 filed on Mar. 26, 2012 which claims the benefit of U.S. Provisional Application No. 61/573,943, filed on Sep. 15, 2011. The entire disclosure of the above application is incorporated herein by reference.

FIELD

The present disclosure relates to structural reinforcement members used in residential and commercial buildings to reinforce structural walls against weather including storm forces.

BACKGROUND

This section provides background information related to the present disclosure which is not necessarily prior art.

The closest art known is a product referred to as "Hurricane Clips" which is offered in one of several simple bracket stampings which can be classified as "nail-type" fasteners. The known nail-type fasteners provide some resistance to lifting forces or tension forces, however, the nail-type fasteners do not provide resistance to torsion forces, nor do the known nail-type fasteners provide compressive load support. Furthermore, the nail-type fasteners do not provide a means to fasten and/or secure roof construction materials directly to foundational elements.

SUMMARY

This section provides a general summary of the disclosure, and is not a comprehensive disclosure of its full scope or all of its features.

The present invention provides an anti-torsion roof element used in construction of residential homes and other buildings. The anti-torsion roof element provides a fastening system of at least two fasteners juxtaposed to the roof element on each side. The fasteners provide resistance to torsion forces which would try to twist or wrench the roof element about its own axis. The anti-torsion roof element further provides a positive tension device resisting lifting forces of anything anchored to the anti-torsion roof element, a positive compression device improving support for compressive loading to roof elements anchored to the anti-torsion roof element, and at least one planar surface parallel to a designated roof construction, such as a rafter or joist or truss construction surface, such that the roof construction material can be secured to the planar surface of the anti-torsion roof element, which extends resistance to torsion forces into the roof construction which heretofore had little or no positive anti-torsion resistant abilities.

According to several aspects, a roof member anti-torsion bracket device includes a base plate that is adapted to sit on a top plate of a wall construction and to receive a truss assembly. At least one transverse planar surface is oriented substantially transverse to the base plate. At least one locating tab is provided to locate the anti-torsion bracket device an offset distance from an edge of the wall construction top plate.

According to other aspects, a roof member anti-torsion bracket device includes a base plate that is adapted to sit on a top plate of a wall construction and to receive a truss assembly. At least one transverse planar surface is oriented substantially transverse to the base plate. A locating tab extending longitudinally with respect to the base plate abuts an edge of the top plate, thereby locating the anti-torsion bracket device an offset distance from the edge of the wall construction top plate. The base plate further includes first and second fastening openings oppositely located with respect to the at least one transverse planar surface. The first and second fastening openings define first and second fastening positions in the base plate thereby providing torsion resistance, compressive load support, and tension lifting resistance for the base plate.

According to still further aspects, a method is provided for using a roof member anti-torsion bracket device. The anti-torsion bracket device includes a base plate, at least one transverse planar surface, a locating tab, and first and second fastening openings. The method includes: orienting the at least one transverse planar surface substantially transverse to the base plate; positioning the base plate on a top plate of a wall construction; locating the first and second fastening openings oppositely with respect to the at least one transverse planar surface; thereby defining two fastening positions in the base plate; and extending first and second fasteners through the top plate and the first and second fastening openings to thereby provide torsion resistance, compressive load support, and tension lifting resistance for the base plate.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
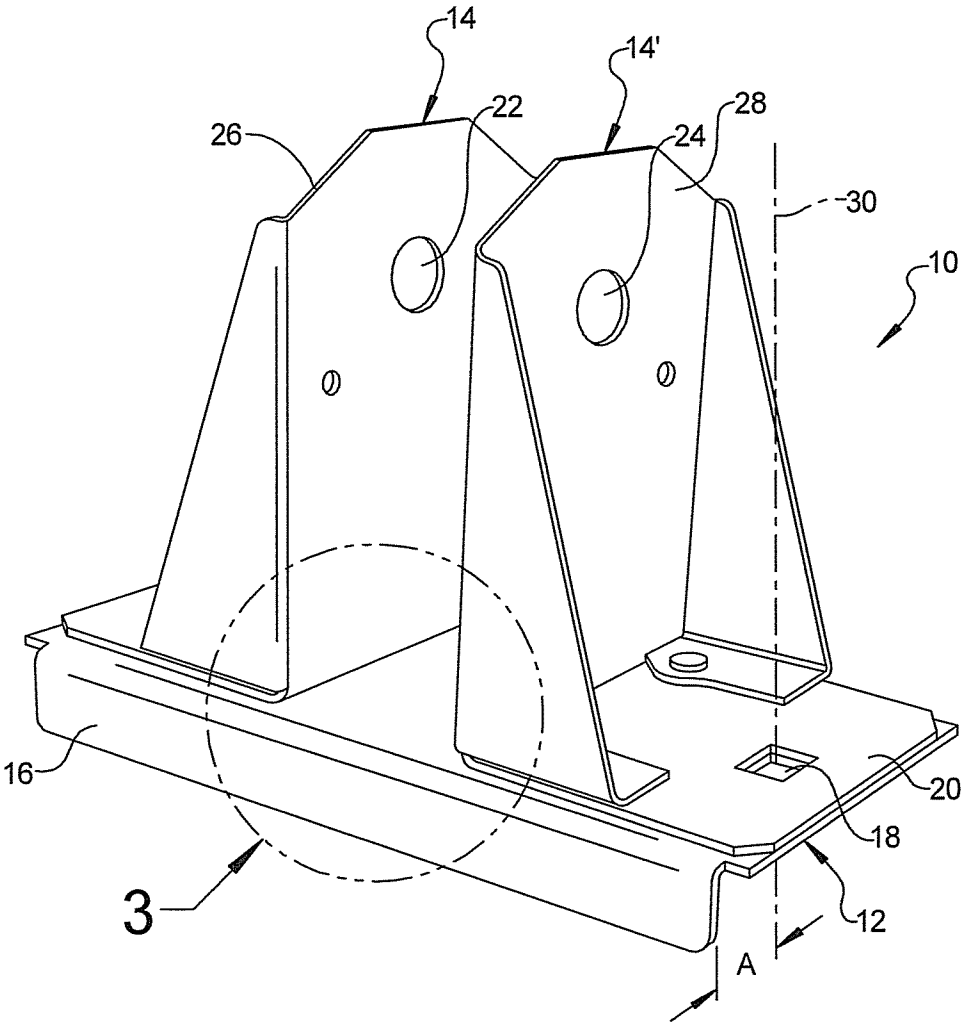
FIG. 1 is a front left perspective view of a first embodiment of an anti-torsion bracket device.

Referring to FIG. 1, one preferred embodiment of the present invention relates to a roof member anti-torsion bracket device 10 having a base plate 12 provided along with at least one transverse planar surface 14 oriented substantially transverse to the base plate 12. The anti-torsion bracket device 10 is adapted to have the base plate 12 sit on a top plate such as a double top plate wall construction (shown in reference to FIG. 2) ready to receive a typical truss assembly. At least one locating tab 16 is provided to locate the anti-torsion bracket device 10 a proper offset distance from the edge of the wall construction double top plate. In at least one and according to several embodiments, the roof member anti-torsion bracket device 10 includes opposed first and second brackets 26, 28, each having a base plate portion 20 connected to the base plate 12. First and second fastening openings 18, 18' are provided in the base plate portions 20 of the first and second brackets 26, 28 and the base plate 12. The fastening openings 18, 18' may be round, oval, square, rectangular, or any appropriate shape to suit an application. In one preferred embodiment square or rectangular fastening openings 18, 18' (fastening opening 18' is not visible in the view of FIG. 1) are provided. The at least one locating tab 16 extends longitudinally to easily and properly locate the anti-torsion bracket device 10 on the double top plate wall construction (shown in reference to FIG. 2) so that a pair of opposed through holes 22, 24 individually created in the opposed first and second brackets 26, 28 connected to the base plate 12 of anti-torsion bracket device 10 are oriented transverse to a planar surface defined by base plate 12 and will therefore be transversely aligned with cooperating anchoring means to foundational elements (each shown in reference to FIG. 2). The through holes 22, 24 may be round, oval, square, rectangular, or any appropriate shape to suit an application. The locating tab 16 is provided to locate the anti-torsion bracket device 10 a proper offset distance "A" from the edge of the wall construction double top plate (shown in reference to FIG. 2) with respect to a centerline 30 of rectangular fastening openings 18, 18'.

Figure 2:
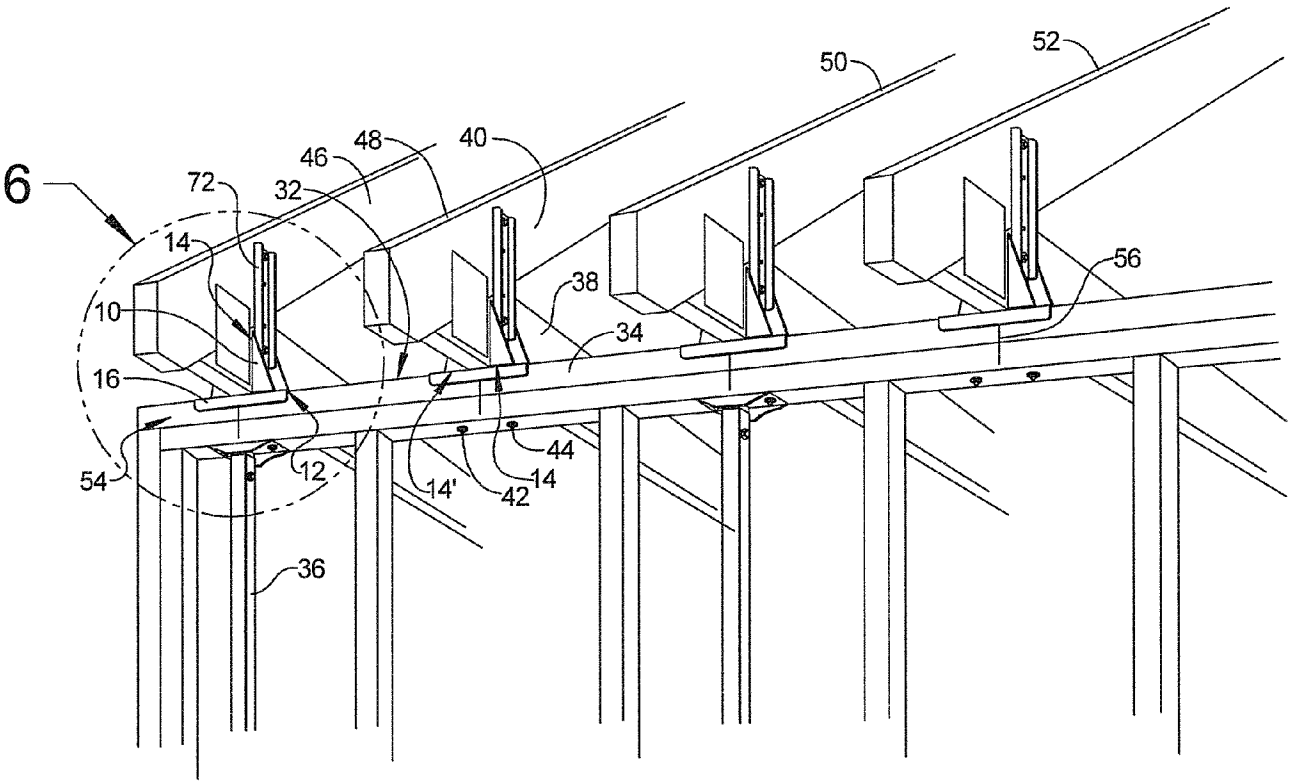
FIG. 2 is a front left perspective view of a building framework having multiple ones of the anti-torsion bracket devices of FIG. 1.
Figure 3:
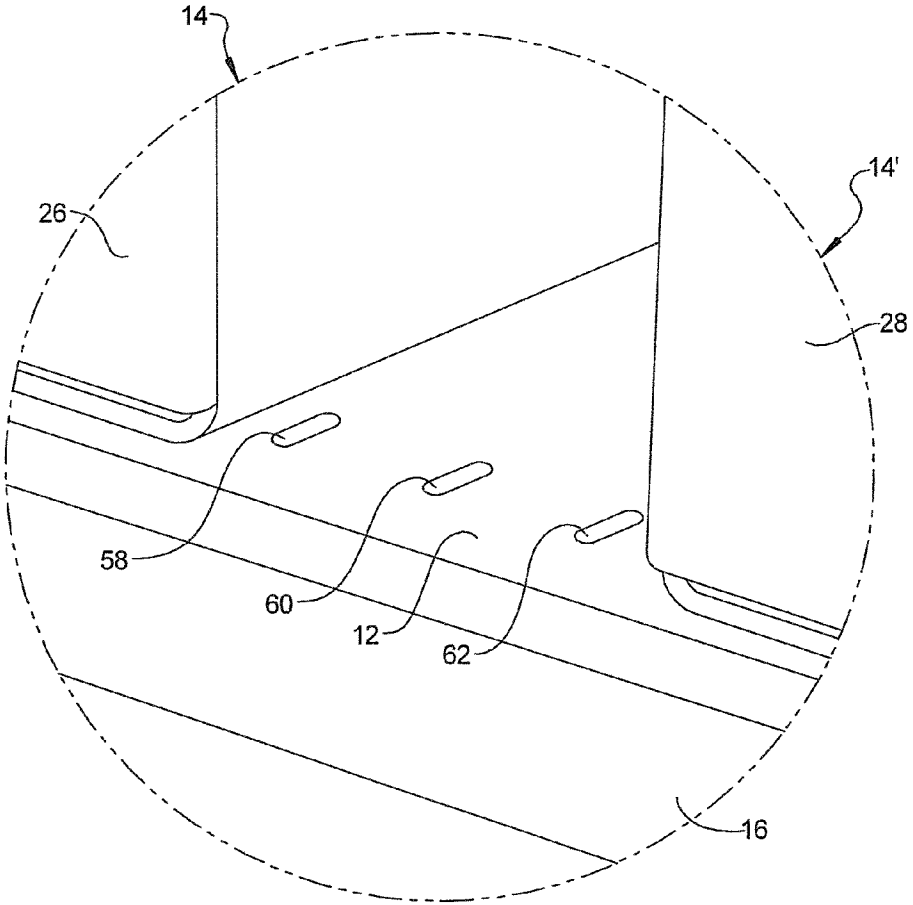
FIG. 3 is a front left perspective view of area 3 of FIG. 1.

Referring to FIG. 2, the base plate 12 is attached to a top surface 32 of a typical double top plate wall construction 34 and anchored firmly, for example by bolting through the double top plate wall construction 34 to foundational elements including via a structural column 36 positioned between studs of the construction. The transverse planar surface 14, 14' of each of the first and second brackets 26, 28 is anchored to selected roof elements, such as a roof joist or roof truss top chord 40 and/or a roof rafter or roof truss bottom chord 38, which in turn are effectively anchored to the foundational elements via the anti-torsion bracket device 10. At least two fastening positions 42, 44 in the base plate 12 provide torsion resistance, compressive load support, and tension lifting resistance. The subject invention is constructed with reinforcements providing resistance to the transverse planar surface from being separated and/or being changed from a transverse orientation. FIG. 2 shows a series of anti-torsion bracket devices 10 of a preferred embodiment shown in FIG. 1. The linear array of anti-torsion bracket devices 10 is sitting on a typical double top plate wall construction 34 with a series of typical truss assemblies 46, 48, 50, 52. The locating tab 16 of each anti-torsion bracket device 10 is provided to locate each device at the proper offset distance from an edge 54 of the wall construction double top plate wall construction 34. At least one and according to several embodiments multiple locating features 58, 60, 62 (shown in reference to FIG. 3) are provided on the base plate 12 to assist the contractor in locating the anti-torsion bracket devices 10. The locating features 58, 60, 62 are provided on the base plate 12 between the transverse planar surfaces 14, 14' to assist the contractor in locating the anti-torsion bracket devices 10 using individual ones of multiple sequentially located spacing marks 56. The locating features may be a slot as shown in FIG. 3, or any other appropriate shaped opening, and may be alternately placed in locating tab 16. The locating features may also be a notch or other appropriate indicating shape located on an edge of the base plate 12 or alternately located on locating tab 16.

Referring to FIG. 3 and again to FIG. 2, the at least one and according to several embodiments three locating features 58, 60, 62 are provided with each anti-torsion bracket device 10 to easily and properly locate the anti-torsion bracket devices 10 on the typical double top plate wall construction 34, allowing the contractor to position the anti-torsion bracket device 10 on spacing marks 56 measured off for proper spacing. In this exemplary preferred embodiment, each of the locating features 58, 60, 62 defines a small elongated or slot-shaped hole providing the contractor with a visual aide allowing ease of proper spacing of the subject anti-torsion bracket devices 10 in a typical construction application, saving time and money.

Figure 4:
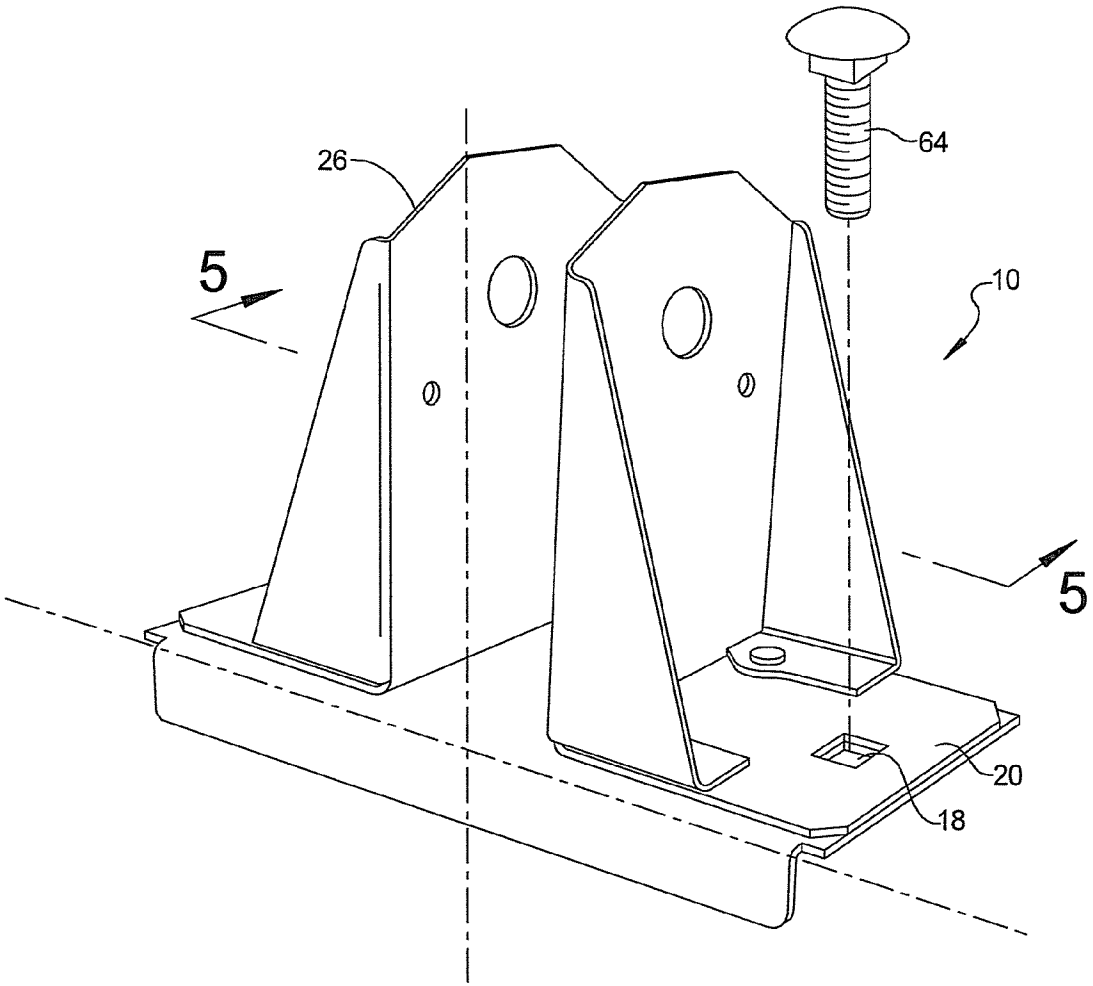
FIG. 4 is a front left perspective view of the anti-torsion bracket device of FIG. 1 adapted to receive a bolt assembly.

Referring to FIG. 4, another feature of anti-torsion bracket device 10 provides the square or rectangular shaped fastening openings 18, 18' suitable to receive standard carriage bolts 64 so that ease of installation and bolting is extended to the contractor saving time and money during installation. FIG. 4 shows rectangular fastening opening 18; however, second rectangular fastening opening 18' positioned to the left of first bracket 26 as viewed in FIG. 4 is not visible.

Referring to FIG. 5 and again to FIGS. 1-2, in another aspect of anti-torsion bracket devices 10, the pair of transverse planar surfaces 14, 14' is designed to receive the standard roof truss assembly 46, 48, 50, 52. The pair of transverse planar surfaces 14, 14' defined by the first and second brackets 26, 28 straddle individual ones of the truss assemblies 46, 48, 50, 52 to provide secure anchoring resistance to torsion forces. In addition, anti-torsion bracket devices 10 provide resistance to tension lifting forces and provide compression load support to the truss. According to one embodiment, each anti-torsion bracket device 10 is installed with the roof truss bottom chord 38 bolted using a bolt assembly 66 extending through the roof truss bottom chord 38, both the pair of transverse planar surfaces 14, 14', and first and second brackets 26, 28.

Figure 5:
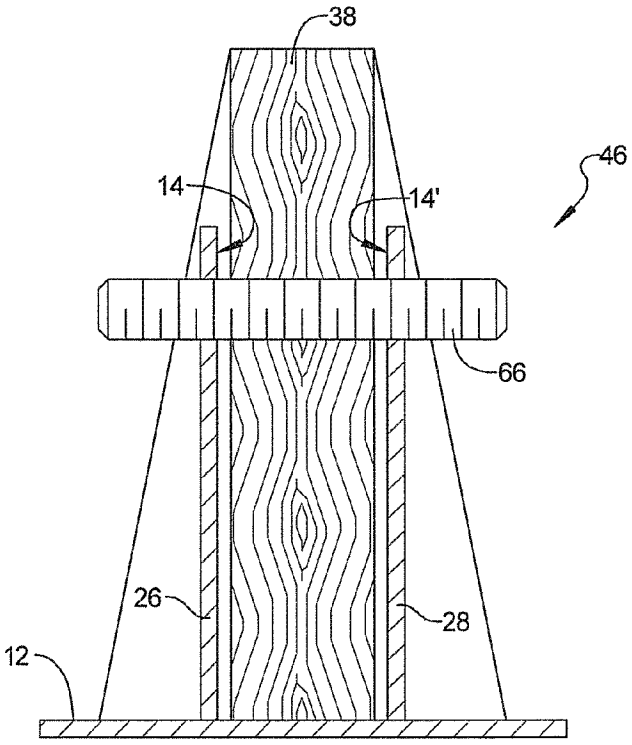
FIG. 5 is a cross sectional front elevational view through section 5 of FIG. 4.
Figure 6:
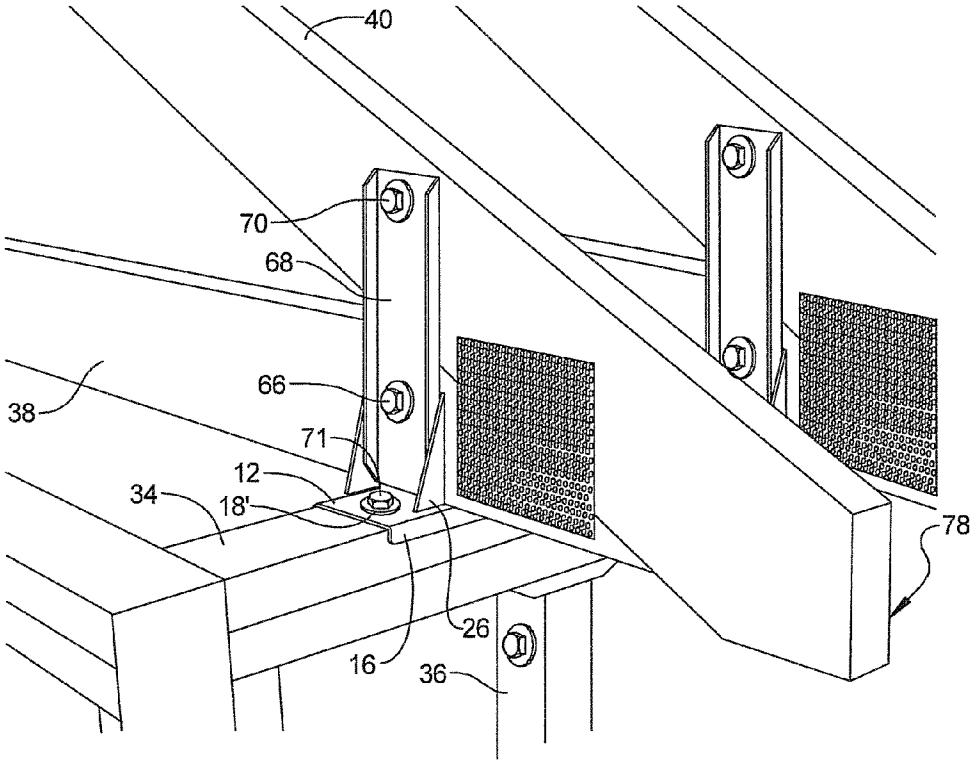
FIG. 6 is a right front perspective view of area 6 of FIG. 2.

Referring to FIG. 6 and again to FIGS. 1-5, for selected applications, an extension bracket 68 is vertically upwardly attached from the anti-torsion bracket device 10 to further secure the roof truss top chord 40 of the roof truss construction using bolt assembly 66 extending through extension bracket 68 in addition to the configuration shown in FIG. 5. A second bolt assembly 70 extends through extension bracket 68 and roof truss top chord 40. The extension bracket 68 securely connects the roof truss top chord 40 to the first bracket 26 and subsequently ties it in a continuous load path to the structural column 36, which is in turn connected to foundational elements. As shown in FIG. 2, a second truss extension bracket 72 can also be oppositely positioned about truss top chord 40 (or any other ones of the top chords) with respect to truss extension bracket 68 to sandwich the top chord between the truss brackets. A fastener such as a bolt assembly 71 extends through each of the fastening openings 18, 18' (only fastening opening 18' is visible in this view) to engage the base plate 12 with the top plate wall construction 34.

Referring to FIG. 7 and again to FIGS. 1-6, according to a further embodiment, an anti-torsion bracket device 74 is modified from anti-torsion bracket device 10 to provide an opposed pair of transverse planar surfaces 76, 78 defined by opposed first and second brackets 80, 82 that are similar to first and second brackets 26, 28 which are separated from each other to receive a standard roof rafter 84 and a standard roof joist 86 construction elements. The anti-torsion bracket device 74 is shown with rafter 84 and joist 86 through bolted in place using a bolt assembly 88.

Referring to FIGS. 8A, 8B, 9A, and 9B, truss bracket assemblies of the present disclosure provide transverse planar surfaces which straddle the joist and rafter elements, thereby providing a secure anchoring resistance to both torsion forces and rhombus forces.

Figure 8B:
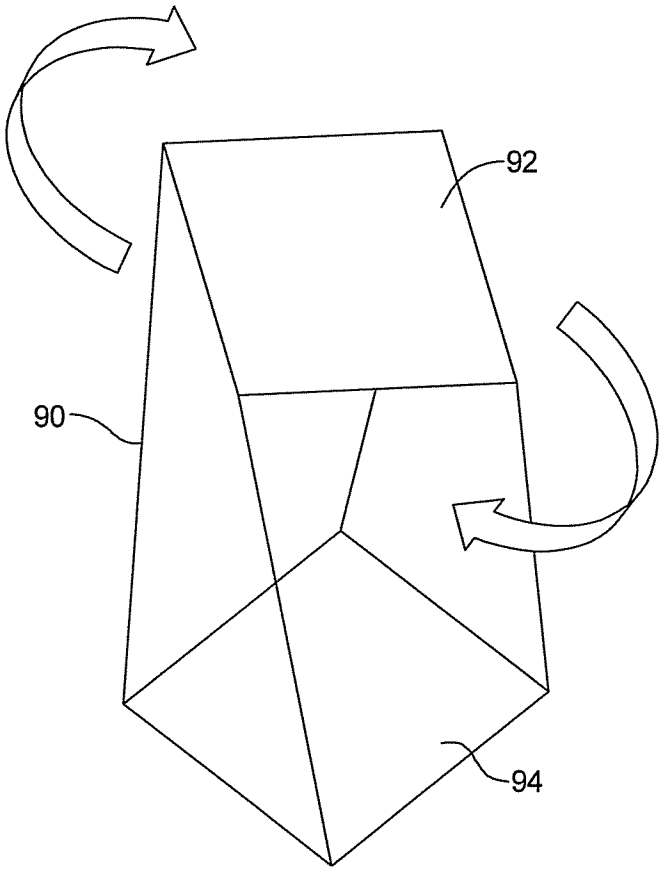
FIG. 8B is a schematic top front perspective view of the construction of FIG. 8A following application of torsion forces.
Figure 8A:
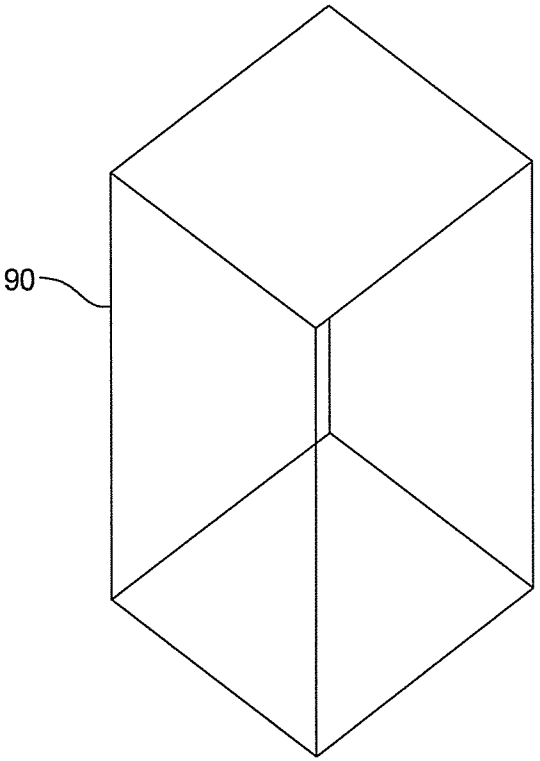
FIG. 8A is a schematic top front perspective view of a construction prior to application of torsion forces.

With specific reference to FIG. 8A, a schematic representation of a construction or structure 90 prior to being subjected to torsion forces is presented. With specific reference to FIG. 8B, a schematic is shown after the structure 90 has been subjected to torsion forces. Torsion forces are commonly associated with tornadic and strong storm winds such that an entire structure can be effectively twisted in response to torsion forces. Upper portions 92 of the structure 90 will twist relative to lower portions 94 of the structure 90 because generally the lower portions 94 of the structure are fastened to foundational elements allowing the structure walls to effectively twist and flex as the upper portions 92 of the structure 90 respond to torsion. The present invention overcomes the inherent weakness in common construction to yield to torsion forces by providing at least two fasteners straddling the structural column. Furthermore, the entire structure of the preferred embodiments is effectively unitized, increasing the structural integrity of the entire structure against torsion forces. In addition, the subject invention provides resistance to tension lifting forces and provides compression load support to the truss.

Figure 9B:
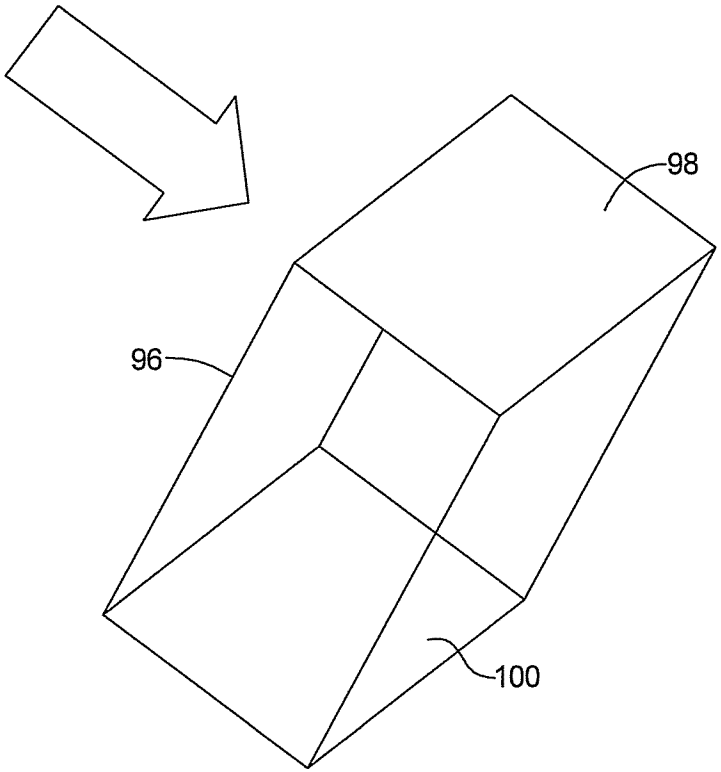
FIG. 9B is a schematic top front perspective view of the construction of FIG. 9A following application of rhombus forces.
Figure 9A:
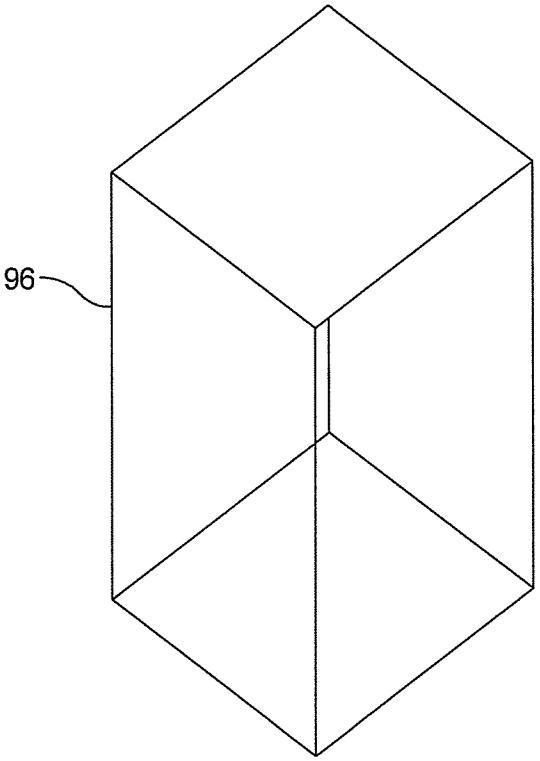
FIG. 9A is a schematic top front perspective view of a construction prior to application of rhombus forces.

With specific reference to FIG. 9A, a schematic representation of a construction or structure 96 prior to being subjected to rhombus forces is presented. With specific reference to FIG. 9B, a schematic is shown after the structure 96 of FIG. 9A has been subjected to rhombus forces. Rhombus forces are commonly associated with tornadic and strong storm winds such that an entire structure can be effectively pushed laterally in response to side load forces. The upper portions 98 of the structure 96 will shift laterally relative to the lower portions 100 of the structure 96 because generally the lower portions 100 of the structure are fastened to foundational elements, allowing the walls to effectively become rhombus shaped and flex as the upper portions 98 of the structure respond to the rhombus forces. The present invention overcomes the inherent weakness in common construction to yield to rhombus forces by providing at least two fasteners straddling the structural column. Furthermore, the entire structure of the preferred embodiments is effectively unitized, thereby increasing the structural integrity of the entire structure against rhombus forces.

Figure 7:
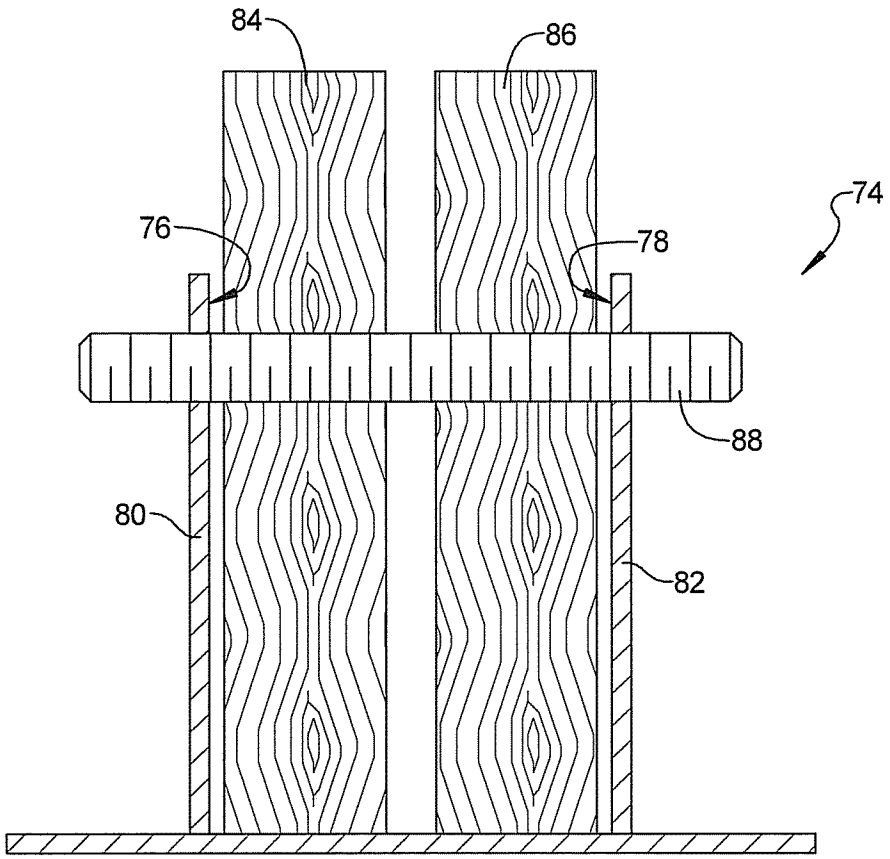
FIG. 7 is a cross sectional front elevational view similar to FIG. 5 showing another embodiment of an anti-torsion bracket device adapted to receive two roof members.

Referring to FIG. 10 and again to FIG. 7, according to a further embodiment, an anti-torsion bracket device 102 is modified from anti-torsion bracket device 74 and includes a central divider tab 104 oriented transverse to a surface 106 of a base plate 108, and located substantially central to a pair of transverse planar surfaces 110, 112 of opposed first and second brackets 114, 116 set to receive rafter 84 and joist 86. The central divider tab 104 is positioned to be located between the rafter 84 and the joist 86 so that either rafter 84 or joist 86 can be assembled individually into proper position independent of the other roof element. This method of assembly and construction of roof elements saves time and money to contractors during the building process. The divider tab 104 also allows and insures the first roof element (rafter 84 or joist 86) to be installed while maintaining proper alignment during installation and preserving the mounting space required for the other roof element. It is a common problem for roof elements to be warped and/or out of plane upon installation, which can make it difficult for both roof elements to be simultaneously installed properly in the truss bracket assembly. The divider tab 104 overcomes this problem.

Figure 10:
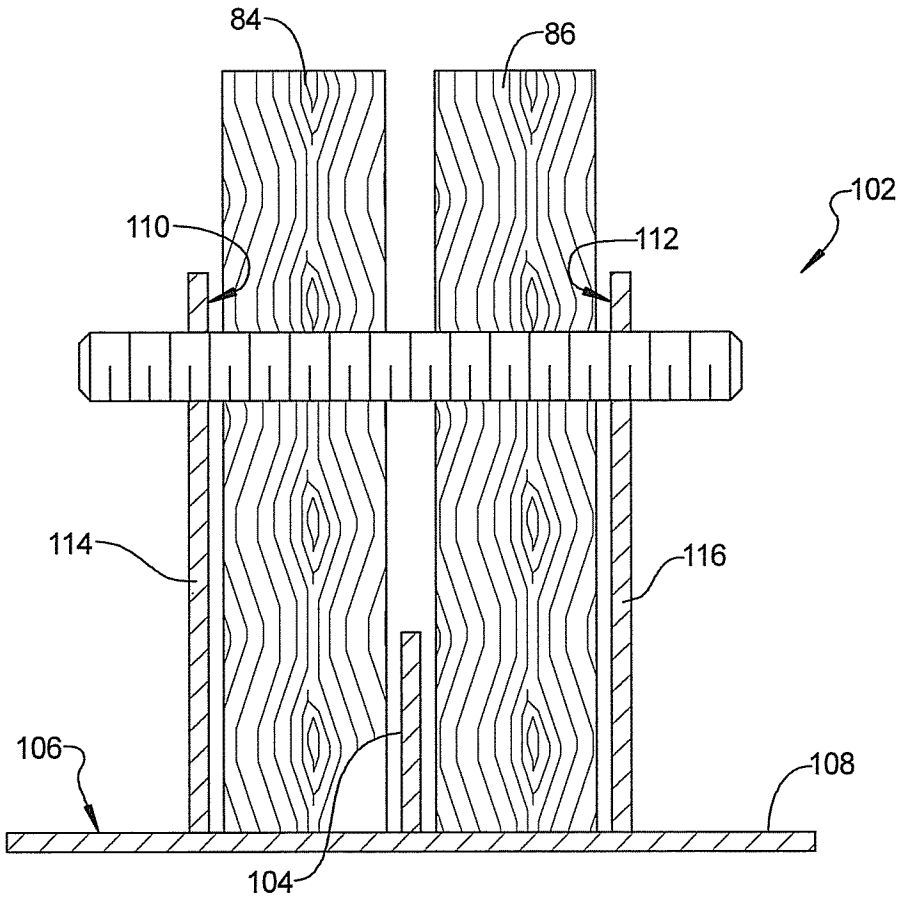
FIG. 10 is a cross sectional front elevational view similar to FIG. 7 of an embodiment of an anti-torsion bracket device adapted to receive two roof members modified to include a divider tab between the roof members.

Those skilled in the art and familiar with construction systems will appreciate that the embodiments shown in FIG. 7 and FIG. 10 may also be easily applied to construction applications requiring three, four, or more side-by-side roof elements assembled by a bracket. The features of the present disclosure are not limited to one or two roof element scenarios and may be applied to any construction materials or combinations of construction materials which are eligible to be structurally enhanced to resist the destructive wind forces described herein.

According to several embodiments, a variety of interchangeable transverse planar surfaces cooperate with a common base plate to facilitate different construction applications of roof elements of different sizes and roof pitches. According to additional embodiments, one planar surface of the structural roof element is positioned such that it will be located effectively flush with a designated roof construction surface. The roof construction surface and material can be easily fastened to the structural roof element and secured such that torsion forces resident in the structural roof element are transferred and/or extended to the roof construction material.

Alternate embodiments include applications for other roof applications such as engineered beams, special truss applications, and other custom roof elements. In addition, other alternate embodiments include applications for multi-story floor joist systems.

The present invention provides at least the following: a device capable of resisting torsion forces such as the wrenching forces imposed on structures during tornadic storm events; a device capable of supporting compression loads in a roof construction; a device capable of resisting tension forces such as those imposed on a roof construction during the suction of severe wind storms as seen in hurricanes and tornadic events; a device capable of fastening roof construction materials to the roof element so as to enhance their respective structural integrity; and a method of installation wherein the features of the subject invention are connected directly to foundational construction elements, and to cooperate to provide the contractor and end user with improved construction techniques to save time and money.

The present invention provides several advantages, including providing the user with a novel method of use improving standard construction techniques. The method of use is demonstrated by the contractor being able to layout the roof construction of a typical frame building using typical methods such as constructing the wall on the floor and then raising the wall section up into place. The subject invention further provides the contractor the method and ability to lay out the wall and structural roof elements together such that when the wall is raised into place, all of the locations for the subject invention will be known and prepared in advance with appropriate fitted holes in the upper double plate for securing the entire structure together. Furthermore, the roof element can be installed on the wall construction prior to raising the wall.

The present invention also provides a further method of saving time and money to the contractor by facilitating a natural receiving and locating means to install rafters, joist, trusses, and other roof constructions. The installed roof elements of the subject invention provide easy alignment and location of the roof construction materials and further provide a means to securely fasten them and tie them directly to anti-torsion features of the subject invention and further tie them directly to foundational construction elements.

Those skilled in the art will readily recognize and appreciate additional features and advantages inherent in the subject invention device beyond those articulated in this disclosure.

The typical embodiment construction material for the structural enhanced components of the present disclosure is metal. The components may be manufactured from metal using any one of several typical methods such as stamping, forging, bending, welding, or combinations of fabrication methods. In addition, the components may be manufactured from non-metal materials such as plastic, reinforced plastic, fiberglass, composites, and/or any other appropriate technology materials suitable to provide the strength requirements for a given application.

The embodiments of the structural enhancement components of the present disclosure are shown in cooperation with commonly known wood construction elements, however the features and improvements of the present disclosure are also applicable to other construction materials including but not limited to metal stud walls, composite materials, and other construction materials which are subject to the destructive wind forces described herein.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A roof member anti-torsion bracket device, comprising:

a base plate adapted to sit on a top plate of a wall construction;

opposed first and second brackets connected to the base plate and directly facing each other, each defining a transverse planar surface oriented substantially transverse to the base plate;

at least one fastener extending through the base plate and through an entire thickness of the top plate of the wall construction to contact a structural column positioned between adjacent studs of the wall construction, the at least one fastener connecting the base plate to the structural column to anchor the base plate of the roof member anti-torsion bracket device to foundational elements via the structural column as part of an interconnected load bearing anti-torsion system, the structural column being separate from the adjacent studs of the wall construction; and at least one extension bracket extending along and beyond the first bracket that provides a remote attachment point for fastening a roof element to the roof member anti-torsion bracket device, the at least one extension bracket having angled sides that nest with side walls of the first bracket that extend transversely with respect to both the base plate and the transverse planar surface of the first bracket.

2. The roof member anti-torsion bracket device of claim 1, wherein the base plate includes multiple parallel elongated holes that are positioned between the transverse planar surfaces of the first and second brackets, each of the multiple parallel elongated holes having a width and a length that is greater than the width, the length of the multiple parallel elongated holes extending in a direction that is parallel to the transverse planar surfaces of the opposed first and second brackets.

3. The roof member anti-torsion bracket device of claim 1, wherein the base plate includes at least one locating tab that extends longitudinally with respect to the base plate and acts to locate the anti-torsion bracket device on the top plate of the wall construction.

4. The roof member anti-torsion bracket device of claim 3, wherein the at least one locating tab is provided to locate the anti-torsion bracket device at an offset distance from an edge of the top plate of the wall construction and further with respect to a centerline of a fastening opening that extends through the base plate and receives the at least one fastener.

5. The roof member anti-torsion bracket device of claim 1, wherein the transverse planar surfaces of the opposed first and second brackets are spaced apart to receive at least one of a roof joist and a roof rafter therebetween.

6. The roof member anti-torsion bracket device of claim 1, wherein the transverse planar surfaces of the opposed first and second brackets are spaced apart to receive part of a roof truss assembly therebetween.

7. The roof member anti-torsion bracket device of claim 1, wherein the base plate includes first and second fastening openings oppositely and outwardly located with respect to the transverse planar surfaces of the opposed first and second brackets, the first and second fastening openings defining at least two fastening positions in the base plate.

8. The roof member anti-torsion bracket device of claim 1, wherein the structural column includes a flanged end and the at least one fastener extends through the base plate, the top plate of the wall construction, and the flanged end of the structural column to secure the base plate of the roof member anti-torsion bracket device to the structural column.

9. A method for using a roof member anti-torsion bracket device, the anti-torsion bracket device including opposed first and second brackets each having a base plate portion and a transverse planar surface, a base plate, a first fastening opening extending through the base plate portion of the first bracket and the base plate, and a second fastening opening extending through the base plate portion of the second bracket and the base plate, the method comprising:

orienting the transverse planar surfaces of the opposed first and second brackets substantially transverse to the base plate;

positioning the base plate portions of the opposed first and second brackets on the base plate such that the base plate portions of the opposed first and second brackets and the base plate are parallel and stacked one above the other;

positioning the base plate on a top plate of a wall construction;

fastening the base plate portions of the opposed first and second brackets and the base plate directly to a structural column positioned between studs of the wall construction by extending first and second fasteners through the top plate of the wall construction and the first and second fastening openings in the base plate portions of the opposed first and second brackets and the base plate to anchor the roof member anti-torsion bracket device to foundational elements via the structural column; and centrally positioning at least one divider tab between the first and second brackets.

10. The method of claim 9, further including positioning a lower chord of a truss between the first and second brackets.

11. The method of claim 10, further including extending a fastener transversely through both the first and second brackets and the lower chord to connect the lower chord to the roof member anti-torsion bracket device and thereby to the top plate.

12. The method of claim 9, further including:

positioning at least one of a roof rafter or a roof joist between the first bracket and the divider tab; and positioning at least a second one of the roof rafter or the roof joist between the second bracket and the divider tab.

13. The method of claim 9, further including extending a locating tab longitudinally with respect to the base plate.

14. The method of claim 13, further including abutting the locating tab with an edge of the top plate to thereby locate the anti-torsion bracket device an offset distance from the edge of the wall construction top plate.

15. A roof member anti-torsion bracket device, comprising:

a base plate adapted to sit on a top plate of a wall construction;

opposed first and second brackets connected to the base plate and directly facing each other, the first bracket having a first transverse planar surface that is substantially transverse to the base plate, the second bracket having a second transverse planar surface that is substantially transverse to the base plate;

a structural column positioned between adjacent studs of the wall construction that is directly bolted to the base plate through the top plate of the wall construction such that the base plate is anchored to foundational elements via the structural column as part of an interconnected load bearing anti-torsion system; and at least one extension bracket extending along and beyond the first bracket that provides a remote attachment point for fastening a roof element to the roof member anti-torsion bracket device, the at least one extension bracket having angled sides that nest with side walls of the first bracket that extend transversely with respect to both the base plate and the first transverse planar surface of the first bracket.

16. The roof member anti-torsion bracket device of claim 15, further including a locating tab integrally connected to the base plate and oriented transversely with respect to the base plate, the locating tab aligned to abut an edge of the top plate thereby locating the anti-torsion bracket device an offset distance from the edge of the top plate.

17. The roof member anti-torsion bracket device of claim 15, wherein the second transverse planar surface of the second bracket is spaced from the first transverse planar surface of the first bracket to permit the placement of a truss or joist between the opposed first and second brackets.

18. The roof member anti-torsion bracket device of claim 15, further including a divider tab integrally connected to the base plate and centrally positioned between the opposed first and second brackets.

19. The roof member anti-torsion bracket device of claim 15, further including a first hole created in the first bracket and a second hole created in the second bracket, the first and second holes aligned with each other to receive a fastener extending through both the first and second brackets and a rafter or a joist positioned between the first and second brackets thereby connecting the rafter or the joist to the anti-torsion bracket device and thereby to the top plate of the wall construction.

20. The roof member anti-torsion bracket device of claim 15, wherein each of the opposed first and second brackets has a base plate portion, the base plate portion of each of the opposed first and second brackets directly contacting the base plate.

21. The roof member anti-torsion bracket device of claim 20, further comprising:

first and second fastening openings oppositely and outwardly located with respect to the first and second transverse planar surfaces of the opposed first and second brackets, the first and second fastening openings extending through the base plate portions of the opposed first and second brackets, the base plate, the top plate of the wall construction, and a flanged end of the structural column.

22. The roof member anti-torsion bracket device of claim 21, further comprising:

first and second bolts disposed in the first and second fastening openings such that the first and second bolts extend through the base plate portions of the opposed first and second brackets, the base plate, the top plate of the wall construction, and the flanged end of the structural column and secure the base plate portions of the opposed first and second brackets and the base plate to the structural column.

* * * * *